US011168857B2

(12) United States Patent
Lee

(10) Patent No.: US 11,168,857 B2
(45) Date of Patent: Nov. 9, 2021

(54) HEADLAMP FOR VEHICLE

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/135,434

(22) Filed: Dec. 28, 2020

(65) Prior Publication Data

US 2021/0199257 A1 Jul. 1, 2021

(30) Foreign Application Priority Data

Dec. 26, 2019 (KR) ..... 10-2019-0175574

(51) Int. Cl.

| | |
|---|---|
| ***F21S 41/25*** | (2018.01) |
| ***F21S 41/40*** | (2018.01) |
| ***F21S 41/143*** | (2018.01) |
| *F21Y 115/10* | (2016.01) |
| *F21W 102/13* | (2018.01) |

(52) U.S. Cl.

CPC ..... *F21S 41/25* (2018.01); *F21S 41/143* (2018.01); *F21S 41/40* (2018.01); *F21W 2102/13* (2018.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 10,591,126 | B2 * | 3/2020 | Mandl | F21S 41/143 |
| 10,612,741 | B2 * | 4/2020 | Moser | F21S 41/285 |
| 10,746,370 | B2 * | 8/2020 | Han | F21S 41/143 |
| 2008/0049165 | A1 * | 2/2008 | Min | G02B 3/0043 349/64 |
| 2016/0265733 | A1 * | 9/2016 | Bauer | F21S 41/20 |
| 2018/0320852 | A1 * | 11/2018 | Mandl | F21S 41/322 |
| 2019/0009706 | A1 * | 1/2019 | Gocke | F21S 41/155 |
| 2019/0186706 | A1 * | 6/2019 | Kim | F21S 41/40 |
| 2019/0301696 | A1 * | 10/2019 | Fischer | F21S 41/275 |
| 2020/0141553 | A1 * | 5/2020 | Han | F21S 41/43 |
| 2020/0332977 | A1 * | 10/2020 | Miedler | F21S 41/153 |
| 2021/0108773 | A1 * | 4/2021 | Kemetmuller | F21S 41/275 |

FOREIGN PATENT DOCUMENTS

KR 10-2017-0054121 A 5/2017

* cited by examiner

*Primary Examiner* — Elmito Breval

(74) *Attorney, Agent, or Firm* — DLA Piper LLP (US)

(57) ABSTRACT

Provided is a headlamp for a vehicle, including: a light source producing light; an optical unit provided in front of the light source, and producing a high beam or a low beam by partially blocking or not blocking the light emitted from the light source; and a micro-lens array provided in front of the optical unit and diffusing the light having passed through the optical unit, wherein the micro-lens array includes: a light incident plate having a number of first microlenses on a light incident surface facing the optical unit, the first microlenses refracting the light having passed through the optical unit forward; and a light exit plate having a number of second microlenses on a light exit surface opposing the light incident surface, the second microlenses diffusing the light having passed through the first microlenses, and the first microlenses and the second microlenses have different shapes.

14 Claims, 12 Drawing Sheets

HEADLAMP FOR VEHICLE

CROSS-REFERENCE TO RELATED APPLICATION

This application is based on and claims the benefit of priority to Korean Patent Application No. 10-2019-0175574, filed on Dec. 26, 2019, in the Korean Intellectual Property Office, the disclosure of which is incorporated herein in its entirety by reference.

TECHNICAL FIELD

The present disclosure relates to a headlamp for a vehicle, to which a micro-lens array is applied.

BACKGROUND

In general, vehicle headlamps are used for: (i) providing a light function in order to view objects; and (ii) providing signals, warnings, and decorations to allow a driver to inform other vehicles or other road users of his or her driving states.

Meanwhile, a vehicle headlamp with a light function includes a light source producing and emitting light, a lens refracting the light emitted from the light source to illuminate the road ahead, a shield forming a high beam or a low beam by blocking part of the light emitted from the light source, and an actuator changing the position of the shield.

However, the aforementioned vehicle headlamp has a limitation in light diffusion, thus making it difficult to achieve a wider angle of visibility.

RELATED ART DOCUMENT

Patent Document: Korean Patent Laid-Open Publication No. 10-2017-0054121

SUMMARY

The present disclosure has been made to solve the above-mentioned problems occurring in the prior art while advantages achieved by the prior art are maintained intact.

An aspect of the present disclosure provides a headlamp for a vehicle, capable of significantly improving the diffusion of light by applying a micro-lens array thereto, thereby achieving a wider angle of visibility.

According to an aspect of the present disclosure, a headlamp for a vehicle may include: a light source producing light; an optical unit provided in front of the light source, and producing a high beam or a low beam by partially blocking or not blocking the light emitted from the light source; and a micro-lens array provided in front of the optical unit and diffusing the light having passed through the optical unit, wherein the micro-lens array may include: a light incident plate having a number of first microlenses on a light incident surface facing the optical unit, the first microlenses refracting the light having passed through the optical unit forward; and a light exit plate having a number of second microlenses on a light exit surface opposing the light incident surface, the second microlenses diffusing the light having passed through the first microlenses, and the first microlenses and the second microlenses may have different shapes.

The first microlens may have a rotationally symmetric structure, and the second microlens may have an asymmetric structure in which a vertical cross-section and a horizontal cross-section have different curvatures.

The first microlens may have an asymmetric structure in which a vertical cross-section and a horizontal cross-section have different curvatures, and the second microlens may have a rotationally symmetric structure.

The second microlens may have a connection surface connected to the light exit surface, the connection surface being circular, the vertical cross-section may have a semicircular shape with a predetermined curvature so that vertical light having passed through the first microlens may be refracted forward, and the horizontal cross-section may have a rectangular shape so that lateral light having passed through the first microlens may be diffused laterally.

A tip portion of the second microlens may be concavely recessed when viewed from the horizontal cross-section.

The first microlens may have a connection surface connected to the light exit surface, the connection surface being circular, the vertical cross-section may have a semicircular shape with a predetermined curvature so that vertical light having passed through the optical unit may be refracted forward, and the horizontal cross-section may have a rectangular shape so that lateral light having passed through the optical unit may be diffused laterally.

The first microlenses provided on the light incident plate and the second microlenses provided on the light exit plate may have the same array structure, or different array structures.

The first microlenses may be spaced apart from each other so as not to contact each other, and the second microlenses may be spaced apart from each other so as not to contact each other.

The micro-lens array may further include: a pair of transparent plates provided between the light incident plate and the light exit plate; and a transparent shield provided between the pair of transparent plates.

According to another aspect of the present disclosure, a headlamp for a vehicle may include: a light source producing light; an optical unit provided in front of the light source, and producing a high beam or a low beam by partially blocking or not blocking the light emitted from the light source; and a micro-lens array provided in front of the optical unit, and diffusing the light having passed through the optical unit, wherein the micro-lens array may include: a light incident plate having a number of first microlenses on a light incident surface facing the optical unit, the first microlenses diffusing the light having passed through the optical unit; and a light exit plate having a number of second microlenses on a light exit surface opposing the light incident surface, the second microlenses diffusing the light having passed through the first microlenses, and the first microlenses and the second microlenses may have the same shape.

The first microlens and the second microlens may have an asymmetric structure in which a vertical cross-section and a horizontal cross-section have different curvatures.

The first microlens may have a connection surface connected to the light incident surface, the connection surface being circular, the vertical cross-section of the first microlens may have a semicircular shape with a predetermined curvature so that vertical light having passed through the optical unit may be refracted forward, and the horizontal cross-section of the first microlens may have a rectangular shape so that lateral light having passed through the optical unit may be diffused laterally. The second microlens may have a connection surface connected to the light exit surface, the connection surface being circular, the vertical cross-section of the second microlens may have a semicircular shape with a predetermined curvature so that vertical light having passed through the first microlens may be refracted forward, and the horizontal cross-section of the second microlens may have a rectangular shape so that lateral light having passed through the first microlens may be diffused laterally.

The first microlenses and the second microlenses may have the same size.

A tip portion of the second microlens may be concavely recessed when viewed from the horizontal cross-section.

The micro-lens array may further include: a pair of transparent plates provided between the light incident plate and the light exit plate; and a transparent shield provided between the pair of transparent plates.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
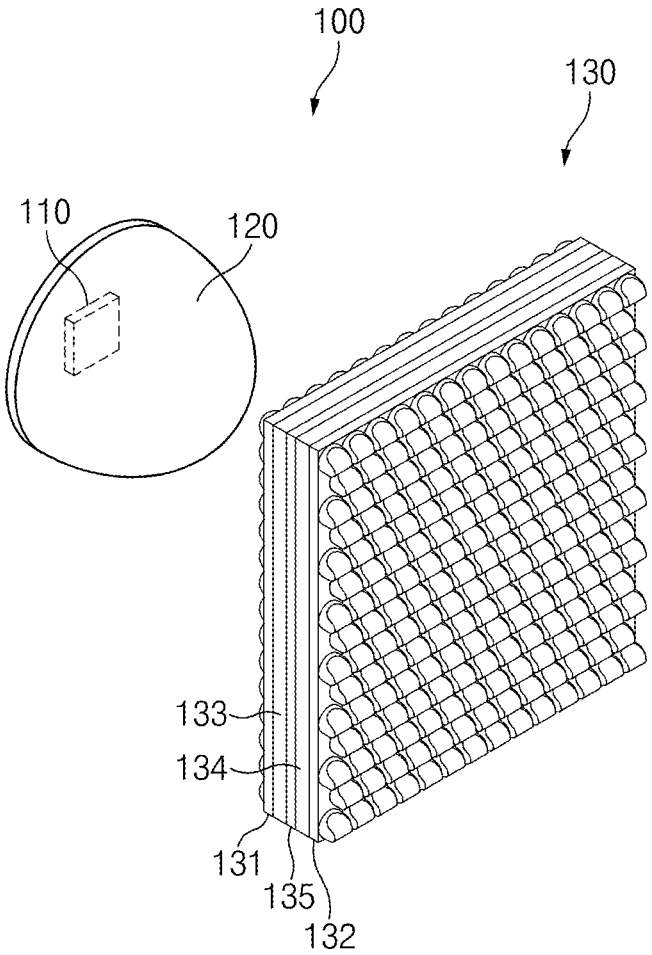
FIG. 1 illustrates a perspective view of a headlamp for a vehicle according to a first exemplary embodiment of the present disclosure.
Figure 2:
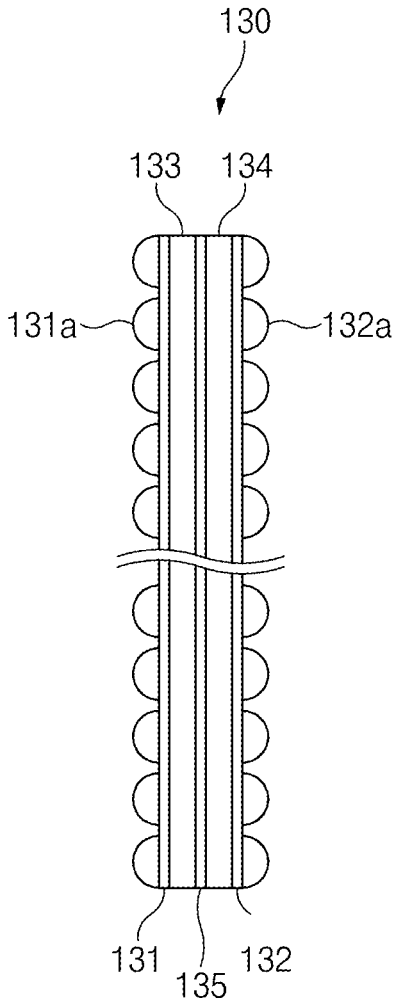
FIG. 2 illustrates a side view of a micro-lens array in the headlamp for a vehicle according to the first exemplary embodiment of the present disclosure.
Figure 3:
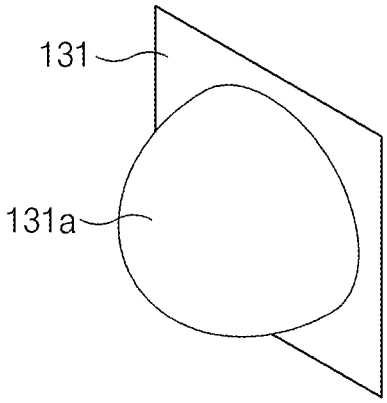
FIG. 3 illustrates an enlarged perspective view of a first microlens.
Figure 4:
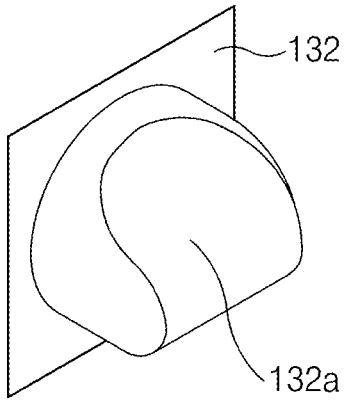
FIG. 4 illustrates an enlarged perspective view of a second microlens.
Figure 5:
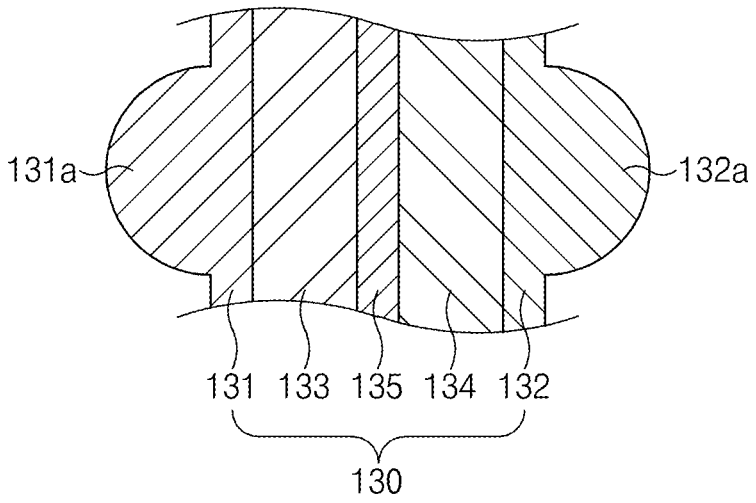
FIG. 5 illustrates a vertical sectional view of a micro-lens array.

Hereinafter, exemplary embodiments of the present disclosure will be described in detail with reference to the accompanying drawings so that those skilled in the art can easily carry out the invention. The invention may, however, be embodied in many different forms and should not be construed as being limited to the embodiments set forth herein. In addition, a detailed description of well-known techniques and constructions will be ruled out in order not to unnecessarily obscure the gist of the present disclosure, and like reference numerals will denote like elements throughout the specification.

[Headlamp for Vehicle According to First Exemplary Embodiment of Present Disclosure]

A headlamp 100 for a vehicle according to a first exemplary embodiment of the present disclosure may include, as illustrated in FIGS. 1 to 8, a light source 110 producing light, an optical unit 120 producing a high beam or a low beam by partially blocking or not blocking the light emitted from the light source 110, and a micro-lens array 130 diffusing the light having passed through the optical unit 120.

Light Source

The light source 110 may be a device that produces light, and a light emitting diode (LED) lamp may be applied thereto. The light source 110 may emit the light to the optical unit 120.

Optical Unit

The optical unit 120 may be provided to form a high beam or a low beam. The optical unit 120 may be provided in front of the light source 110, and produce the high beam or the low beam using the light emitted from the light source 110. For example, the optical unit 120 may produce the high beam or the low beam by partially blocking or not blocking the light of the light source 110.

Micro-Lens Array

The micro-lens array 130 may be provided in front of the optical unit 120, and cause the light having passed through the optical unit 120 to spread in all directions, especially, laterally.

That is, the micro-lens array 130 may include a light incident plate 131 having a number of first microlenses 131*a* on a light incident surface facing the optical unit 120, the first microlenses 131*a* refracting the light having passed through the optical unit 120 forward (that is, toward a light exit plate 132), and the light exit plate 132 having a number of second microlenses 132*a* on a light exit surface opposing the light incident surface, the second microlenses 132*a* diffusing the light having passed through the first microlenses 131*a* in all directions.

Here, the first microlens 131*a* and the second microlens 132*a* may have different shapes. In particular, the second microlens 132*a* may be shaped to increase a diffusion angle of light.

For example, the first microlens 131*a* may have a rotationally symmetric structure, and the second microlens 132*a* may have an asymmetric structure in which a vertical cross-section and a horizontal cross-section are different from each other.

That is, the first microlens 131*a* may have a hemispherical shape, and refract the light that has passed through the optical unit 120 so as to focus the light on a point (focal point) in front of the first microlens 131*a*.

The second microlens 132*a* may have a connection surface connected to the light exit surface, and the connection surface may be circular. The vertical cross-section of the second microlens 132*a* may have a semicircular shape with a predetermined curvature so that vertical light having passed through the first microlens 131*a* may be refracted forward (that is, toward the second microlens), and the horizontal cross-section of the second microlens 132*a* may have a rectangular shape so that lateral light having passed through the first microlens 131*a* may be diffused laterally.

Figure 6:
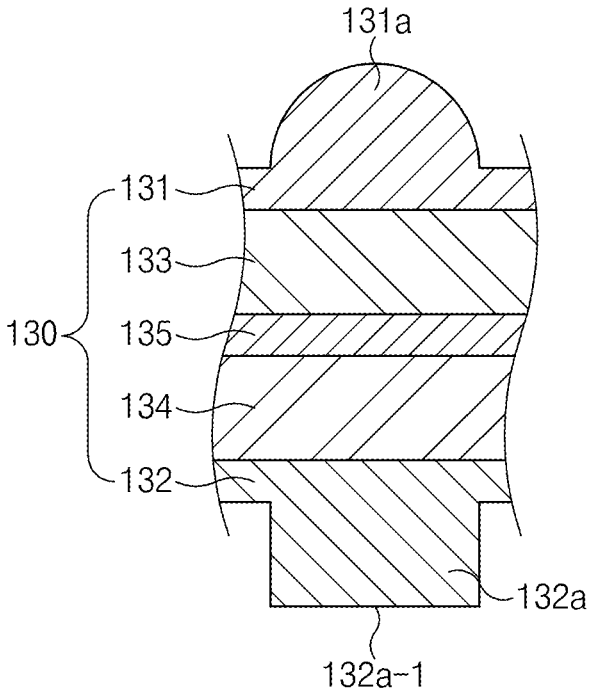
FIG. 6 illustrates a horizontal sectional view of a micro-lens array.

The second microlens 132*a* may have a circular shape when viewed from the rear, have a hemispherical shape when viewed from the side, and have a rectangular shape when viewed from the top. A rear portion (connection surface) of the second microlens 132*a* attached to the light exit plate 132 and a rear portion (connection surface) of the first microlens 131*a* attached to the light incident plate 131 may have the same lateral width as illustrated in FIG. 6. However, a lateral width of a tip portion of the second microlens 132*a* may be greater than that of the first microlens 131*a*, and accordingly, the second microlens 132*a* may allow the light having passed through the first microlens 131*a* to be greatly diffused laterally. As a result, a diffusion angle of light and an angle of visibility may be significantly increased.

The micro-lens array 130 having the aforementioned structure may increase the diffusion angle of light, and ensure a wider angle of visibility.

Meanwhile, the light incident plate 131 and the light exit plate 132 may be made of a transparent synthetic resin material, thereby preventing damage due to external and internal impacts, and improving manufacturing efficiency.

The tip portion of the second microlens 132*a* may be formed as a concavely recessed, curved surface 132*a*-1 when viewed from the horizontal cross-section. Thus, the light having passed through the light incident plate 131 may be refracted so as to be greatly diffused laterally, and consequently the diffusion angle may be increased.

Meanwhile, the plurality of first microlenses 131*a* provided on the light incident plate 131 and the plurality of second microlenses 132*a* provided on the light exit plate 132 may have the same array structure. That is, the plurality of first microlenses 131*a* and the plurality of second microlenses 132*a* may correspond to each other. Accordingly, as the light having passed through the plurality of first microlenses 131*a* directly enters the plurality of second microlenses 132*a*, the light may be evenly diffused. As a result, the brightness of light emitted by the headlamp may be evenly regulated.

Alternatively, the plurality of first microlenses 131*a* provided on the light incident plate 131 and the plurality of second microlenses 132*a* provided on the light exit plate 132 may have different array structures. That is, the plurality of first microlenses 131*a* and the plurality of second microlenses 132*a* may not correspond to each other. Accordingly, as the light having passed through the plurality of first microlenses 131*a* spreads out over the plurality of second microlenses 132*a*, it may be widely diffused. Thus, the headlamp may provide improved illumination by casting the light onto the area that has not been illuminated.

Meanwhile, the plurality of first microlenses 131*a* provided on the light incident plate 131 may be spaced apart from each other so as not to contact each other. In particular, the plurality of first microlenses 131*a* may be spaced apart from each other by 0.2-2 mm. In addition, the plurality of second microlenses 132*a* provided on the light exit plate 132 may be spaced apart from each other so as not to contact each other. In particular, the plurality of second microlenses 132*a* may be spaced apart from each other by 0.2-2 mm. Thus, easiness of manufacturing may be achieved, and the irregular diffusion of light may be prevented.

The micro-lens array 130 may further include a pair of transparent plates 133 and 134 provided between the light incident plate 131 and the light exit plate 132, and a transparent shield 135 provided between the pair of transparent plates 133 and 134. That is, the pair of transparent plates 133 and 134 may increase strength, and the transparent shield 135 may allow the pair of transparent plates 133 and 134 to be firmly attached.

Here, the pair of transparent plates and the transparent shield may have the same size as that of the light incident plate and the light exit plate.

In addition, the pair of transparent plates 133 and 134 may be formed of tempered glass to increase transparency, and the transparent shield 135 may include chromium.

Figure 7:
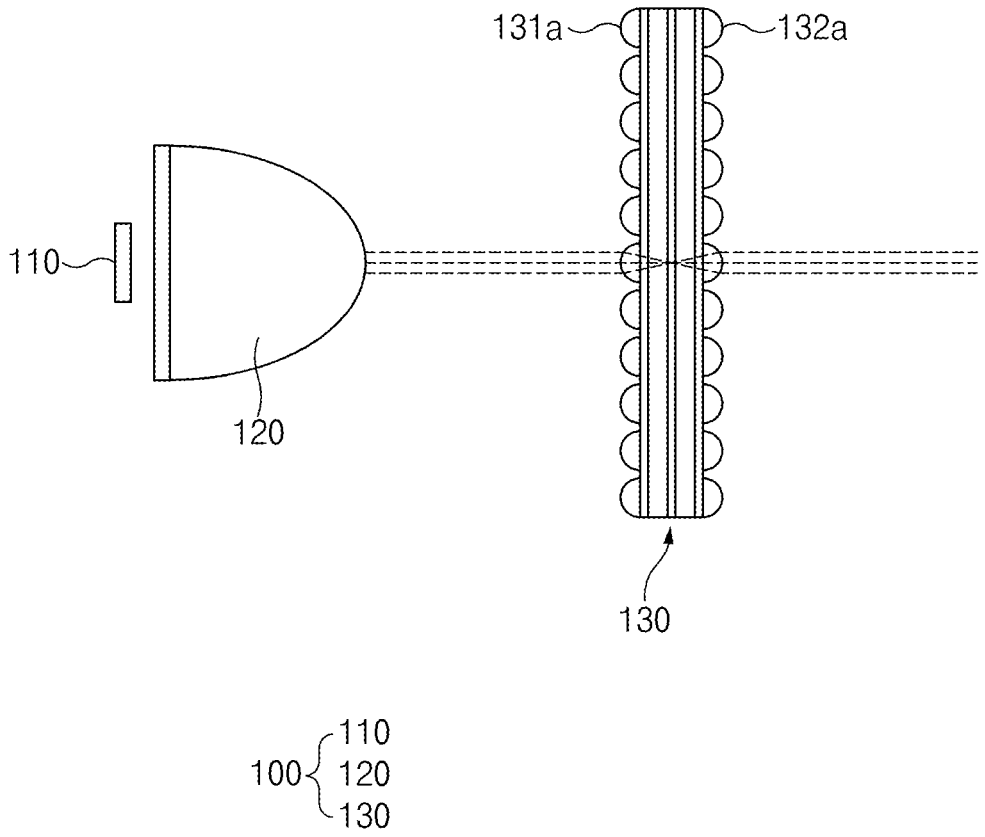
FIG. 7 illustrates a side view of a usage state of the headlamp for a vehicle according to the first exemplary embodiment of the present disclosure.
Figure 8:
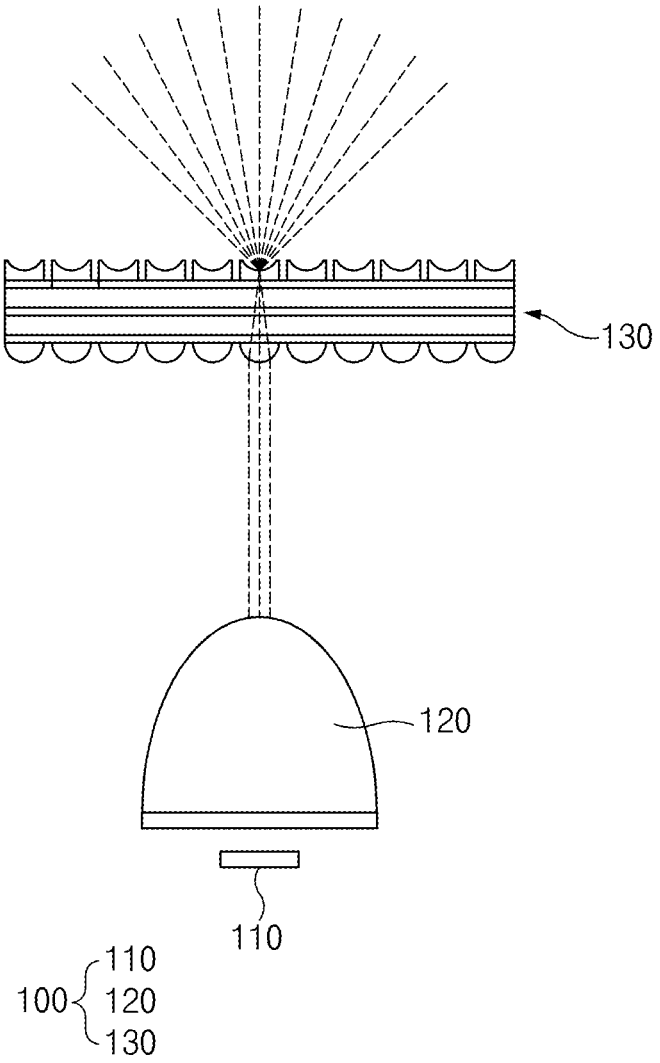
FIG. 8 illustrates a plan view of a usage state of the headlamp for a vehicle according to the first exemplary embodiment of the present disclosure.

Thus, as illustrated in FIGS. 7 and 8, the headlamp 100 for a vehicle according to the first exemplary embodiment of the present disclosure may include the micro-lens array 130 so that the vertical light may be refracted forward to prevent unnecessary light diffusion, and the lateral light may be greatly diffused laterally to ensure a wider angle of visibility.

EXPERIMENTAL EXAMPLES

Comparative Example

Figure 9:
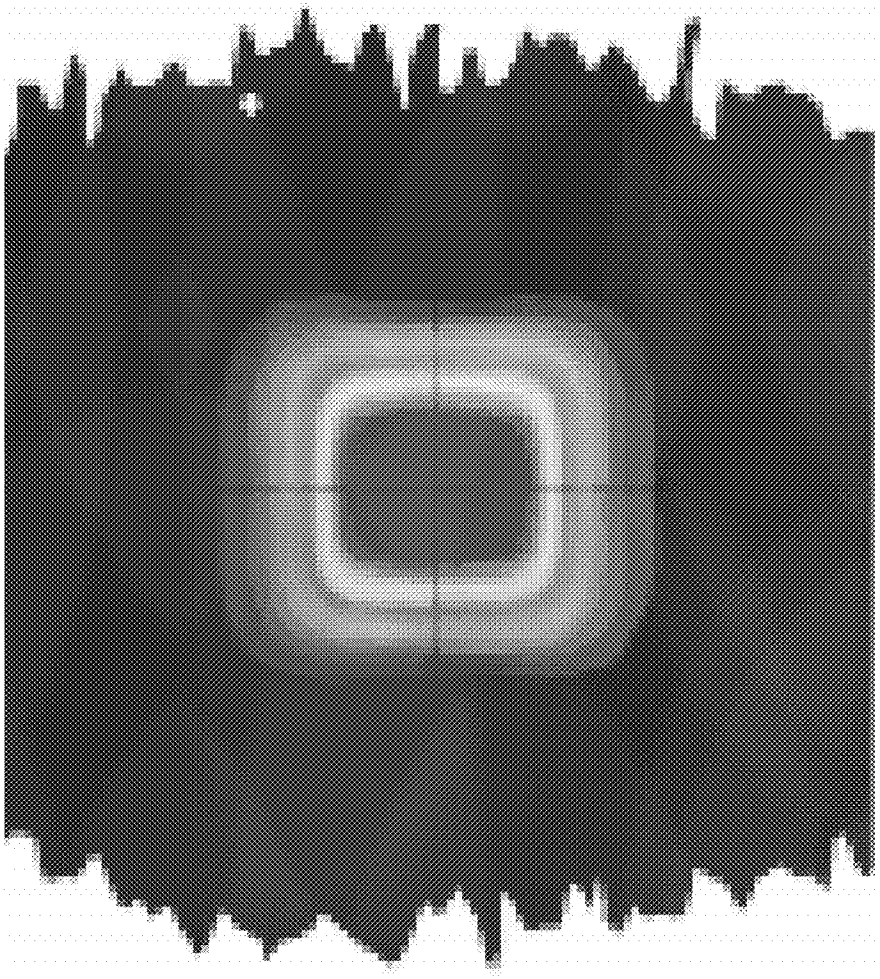
FIG. 9 illustrates simulation results of light diffusion of a headlamp for a vehicle according to the related art.

The diffusion (spread) of light was simulated using a headlamp according to the related art, the headlamp including: a light source; an optical unit; and a micro-lens array in which first microlenses having a rotationally symmetric structure are provided on both surfaces of the micro-lens array. The simulation results were obtained as illustrated in FIG. 9.

Inventive Example

The diffusion (spread) of light was simulated using a headlamp according to an exemplary embodiment of the present disclosure, the headlamp including: a light source; an optical unit; and a micro-lens array in which first and second microlenses are provided. The simulation results were obtained as illustrated in FIG. 10.

Experimental Results

Referring to FIG. 9, the light in the comparative example may be diffused vertically and laterally in a square form. That is, it can be seen that the diffusion of light hardly occurs in the comparative example.

Figure 10:
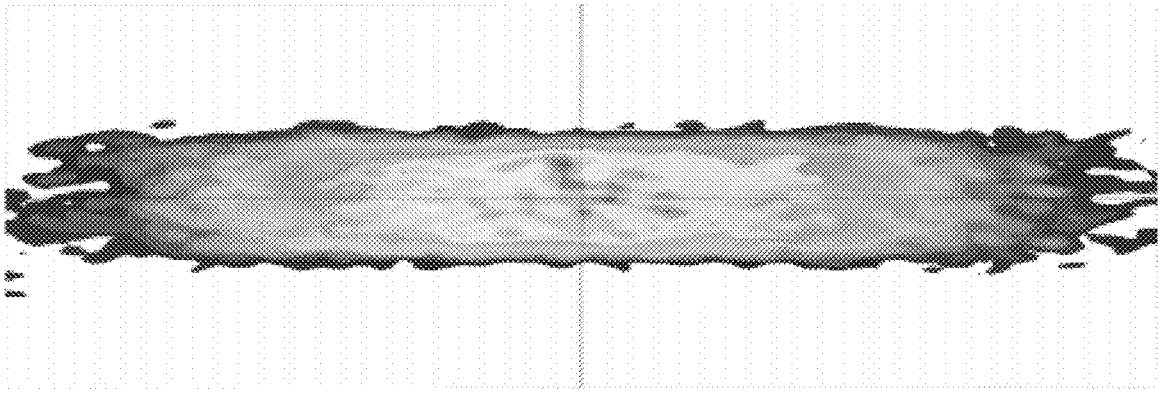
FIG. 10 illustrates simulation results of light diffusion of the headlamp for a vehicle according to the first exemplary embodiment of the present disclosure.

Referring to FIG. 10, the light in the inventive example may be diffused vertically similar to the comparative example, and may be greatly diffused laterally compared to the comparative example.

Thus, it can be seen that the headlamp according to the exemplary embodiment of the present disclosure may provide improved lateral illumination, compared to the related art headlamp.

Hereinafter, in describing the following other embodiments of the present disclosure, the elements having the same functions as in the previous embodiment will be designated by the same reference numerals, and a detailed description thereof will be omitted.

[Headlamp for Vehicle According to Second Exemplary Embodiment of Present Disclosure]

Figure 11:
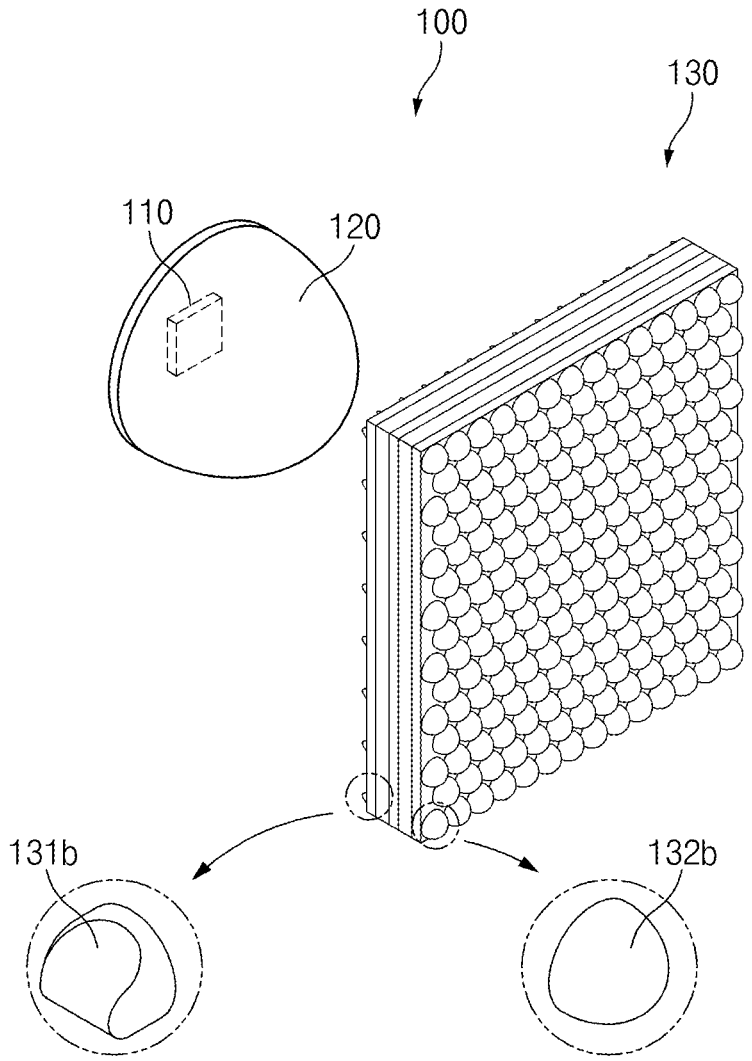
FIG. 11 illustrates a perspective view of a headlamp for a vehicle according to a second exemplary embodiment of the present disclosure.

As illustrated in FIG. 11, the headlamp 100 according to the second exemplary embodiment of the present disclosure may include the light source 110 producing light, the optical unit 120 producing a high beam or a low beam using the light of the light source 110, and the micro-lens array 130 diffusing the light having passed through the optical unit 120.

The micro-lens array 130 may include the light incident plate 131 on which a number of first microlenses 131*b* are provided, and the light exit plate 132 on which a number of second microlenses 132*b* are provided. The first microlens 131*b* and the second microlens 132*b* may have different shapes. In particular, the first microlens 131*b* may be shaped to increase a diffusion angle of light.

For example, the first microlens 131*b* may have an asymmetric structure in which a vertical cross-section and a horizontal cross-section have different curvatures, and the second microlens 132*b* may have a rotationally symmetric structure.

Meanwhile, the first microlens 131*b* in the second exemplary embodiment may have the same structure as that of the second microlens 132*a* in the first exemplary embodiment, and a detailed description thereof will be omitted.

Thus, the headlamp 100 for a vehicle according to the second exemplary embodiment of the present disclosure may significantly diffuse the light laterally through the first microlenses 131*b*, and refract the diffused light forward through the second microlenses 132*b*, thereby increasing the diffusion angle of light. That is, the headlamp 100 for a vehicle according to the second exemplary embodiment may have the smaller diffusion angle of light than that of the headlamp 100 according to the first exemplary embodiment, but may increase the diffusion angle of light compared to the comparative example.

[Headlamp for Vehicle According to Third Exemplary Embodiment of Present Disclosure]

Figure 12:
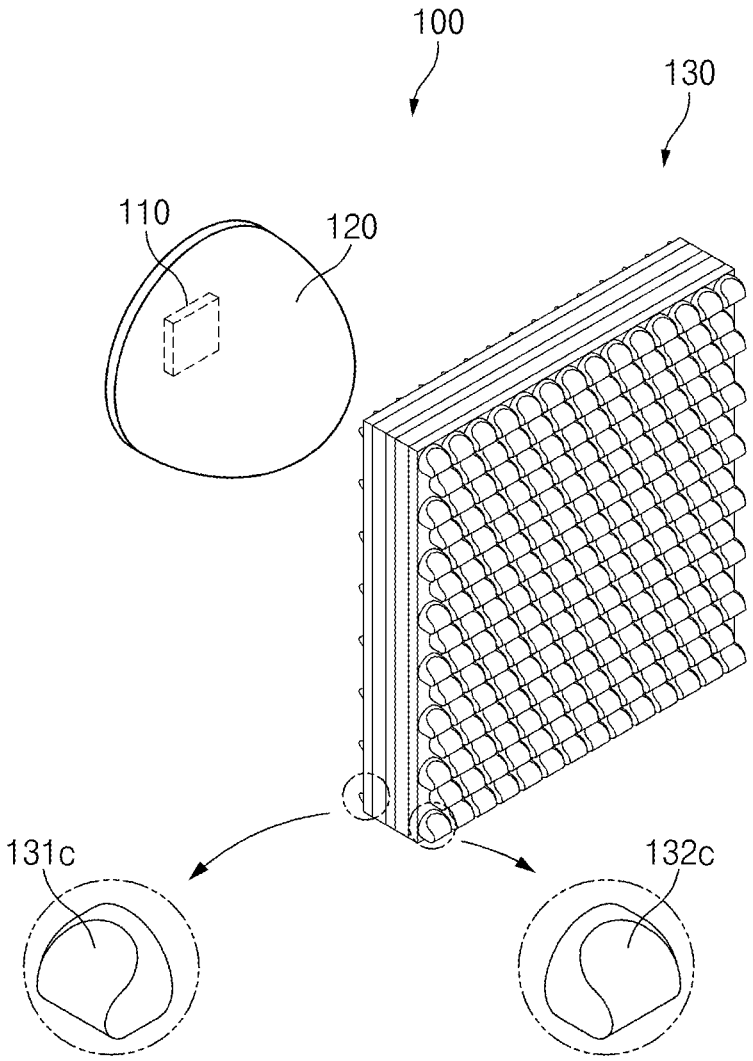
FIG. 12 illustrates a perspective view of a headlamp for a vehicle according to a third exemplary embodiment of the present disclosure.

As illustrated in FIG. 12, the headlamp 100 according to the third exemplary embodiment of the present disclosure may include the light source 110 producing light, the optical unit 120 producing a high beam or a low beam using the light of the light source 110, and the micro-lens array 130 diffusing the light having passed through the optical unit 120.

The micro-lens array 130 may include the light incident plate 131 having a number of first microlenses 131*c* on the light incident surface facing the optical unit 120, the first microlenses 131*c* refracting the light having passed through the optical unit 120 forward, and the light exit plate 132 having a number of second microlenses 132*c* on the light exit surface opposing the light incident surface, the second microlenses 132*c* diffusing the light having passed through the first microlenses 131*c* in all directions.

Here, the first microlens 131*c* and the second microlens 132*c* may have the same shapes. That is, the first microlens 131*c* and the second microlens 132*c* may have an asymmetric structure in which a vertical cross-section and a horizontal cross-section have different curvatures.

For example, the first microlens 131*c* may have a connection surface connected to the light incident surface, and the connection surface may be circular. The vertical cross-section of the first microlens 131*c* may have a semicircular shape with a predetermined curvature so that vertical light having passed through the optical unit 120 may be refracted forward, and the horizontal cross-section of the first microlens 131*c* may have a rectangular shape so that lateral light having passed through the optical unit 120 may be diffused laterally. The second microlens 132*c* may have a connection surface connected to the light exit surface, and the connection surface may be circular. The vertical cross-section of the second microlens 132*c* may have a semicircular shape with a predetermined curvature so that vertical light having passed through the first microlens 131*c* may be refracted forward, and the horizontal cross-section of the second microlens 132*c* may have a rectangular shape so that lateral light having passed through the first microlens 131*c* may be diffused laterally.

Thus, the headlamp 100 for a vehicle according to the third exemplary embodiment of the present disclosure may significantly increase a diffusion angle of light, thereby significantly increasing an angle of visibility.

Meanwhile, the first microlens 131*c* and the second microlens 132*c* may have the same size. Accordingly, as the light having passed through the first microlenses 131*c* directly enters the second microlenses 132*c*, the diffusion angle of light may be increased.

A tip portion of the second microlens 132*c* may be concavely recessed when viewed from the horizontal cross-section. Thus, it may diffuse the light more effectively.

Meanwhile, the micro-lens array 130 may further include a pair of transparent plates provided between the light incident plate and the light exit plate, and a transparent shield provided between the pair of transparent plates, thereby increasing strength.

As set forth above, by applying the micro-lens array to the headlamp according to exemplary embodiments of the present disclosure, the diffusion angle of light may be significantly increased, and thus a wider angle of visibility may be achieved.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A headlamp for a vehicle, the headlamp comprising:

a light source producing light;

an optical unit provided in front of the light source, and producing a high beam or a low beam by partially blocking or not blocking the light from the light source; and a micro-lens array provided in front of the optical unit and diffusing the light having passed through the optical unit, wherein the micro-lens array includes:

a light incident plate having a number of first microlenses on a light incident surface facing the optical unit, the first microlenses refracting the light having passed through the optical unit forward; and a light exit plate having a number of second microlenses on a light exit surface opposing the light incident surface, the second microlenses diffusing the light having passed through the first microlenses, and wherein one of the first microlenses or the second microlenses has an asymmetric structure in which a vertical cross-section and a horizontal cross-section have different curvatures.

2. The headlamp according to claim 1, wherein the first microlenses have a rotationally symmetric structure, and the second microlenses have the asymmetric structure in which the vertical cross-section and the horizontal cross-section have different curvatures.

3. The headlamp according to claim 1, wherein the first microlenses have the asymmetric structure in which the vertical cross-section and the horizontal cross-section have different curvatures, and the second microlenses have a rotationally symmetric structure.

4. The headlamp according to claim 2, wherein the second microlenses have a connection surface connected to the light exit surface, the connection surface being circular, the vertical cross-section has a semicircular shape with a predetermined curvature so that vertical light having passed through the first microlenses is refracted forward, and the horizontal cross-section has a rectangular shape so that lateral light having passed through the first microlenses is diffused laterally.

5. The headlamp according to claim 4, wherein a tip portion of the second microlenses is concavely recessed when viewed from the horizontal cross-section.

6. The headlamp according to claim 3, wherein the first microlenses have a connection surface connected to the light exit surface, the connection surface being circular, the vertical cross-section has a semicircular shape with a predetermined curvature so that vertical light having passed through the optical unit is refracted forward, and the horizontal cross-section has a rectangular shape so that lateral light having passed through the optical unit is diffused laterally.

7. The headlamp according to claim 1, wherein the first microlenses provided on the light incident plate and the second microlenses provided on the light exit plate have the same array structure, or different array structures.

8. The headlamp according to claim 7, wherein the first microlenses are spaced apart from each other so as not to contact each other, and the second microlenses are spaced apart from each other so as not to contact each other.

9. The headlamp according to claim 1, wherein the micro-lens array further includes:

a pair of transparent plates provided between the light incident plate and the light exit plate; and a transparent shield provided between the pair of transparent plates.

10. A headlamp for a vehicle, the headlamp comprising:

a light source producing light;

an optical unit provided in front of the light source, and producing a high beam or a low beam by partially blocking or not blocking the light from the light source; and a micro-lens array provided in front of the optical unit, and diffusing the light having passed through the optical unit, wherein the micro-lens array includes:

a light incident plate having a number of first microlenses on a light incident surface facing the optical unit, the first microlenses diffusing the light having passed through the optical unit; and a light exit plate having a number of second microlenses on a light exit surface opposing the light incident surface, the second microlenses diffusing the light having passed through the first microlenses, and the first microlenses and the second microlenses each have an asymmetric structure in which a vertical cross-section and a horizontal cross-section have different curvatures.

11. The headlamp according to claim 10, wherein the first microlenses have a connection surface connected to the light incident surface, the connection surface being circular, the vertical cross-section of the first microlenses has a semicircular shape with a predetermined curvature so that vertical light having passed through the optical unit is refracted forward, the horizontal cross-section of the first microlenses has a rectangular shape so that lateral light having passed through the optical unit is diffused laterally, the second microlenses have a connection surface connected to the light exit surface, the connection surface being circular, the vertical cross-section of the second microlenses has a semicircular shape with a predetermined curvature so that vertical light having passed through the first microlenses is refracted forward, and the horizontal cross-section of the second microlenses has a rectangular shape so that lateral light having passed through the first microlenses is diffused laterally.

12. The headlamp according to claim 10, wherein the first microlenses and the second microlenses have the same size.

13. The headlamp according to claim 10, wherein a tip portion of the second microlenses is concavely recessed when viewed from the horizontal cross-section.

14. The headlamp according to claim 10, wherein the micro-lens array further includes:

a pair of transparent plates provided between the light incident plate and the light exit plate; and a transparent shield provided between the pair of transparent plates.

* * * * *